US005810070A

United States Patent [19]

Osada et al.

[11] Patent Number: 5,810,070

[45] Date of Patent: Sep. 22, 1998

[54] TWIN ROLL CONTINUOUS CASTER

[75] Inventors: Shiro Osada, Yokohama; Heiji Kato, Yokosuka; Shuzo Takahashi; Shu Ogawa, both of Yokohama, all of Japan

[73] Assignees: Ishikawajima-Harima Heavy Industries Company Limited, Tokyo, Japan; BHP Steel (JLA) Pty Ltd, Melbourne, Australia

[21] Appl. No.: 773,946

[22] Filed: Dec. 30, 1996

[30] Foreign Application Priority Data

Jan. 5, 1996 [AU] Australia ..... PN7432

[51] Int. Cl.[6] ..... B22D 11/06

[52] U.S. Cl. ..... 164/480; 164/428

[58] Field of Search ..... 164/480, 428, 164/479, 429

[56] References Cited

U.S. PATENT DOCUMENTS 5,010,948 4/1991 Blin et al. ..... 164/480

5,588,479 12/1996 Leadbeatter et al. ..... 164/480

*Primary Examiner*—Kuang Y. Lin

*Attorney, Agent, or Firm*—Nikaido, Marmelstein Murray & Oram LLP

[57] ABSTRACT

To suppress wear of side surfaces of end closures due to rotation of cooling rolls in a twin roll strip caster, a pair of housings 11 are provided, each arranged to face on end faces of one or the other ends of cooling rolls 1*a* and 1*b*, which are arranged substantially horizontally and in parallel with each other, so that it may be displaced toward and away from the end faces, rolling members 12 rotatably supported by each of said housings 11 so that they may contact the corresponding end faces of the rolls 1*a* and 1*b*, a thruster body 21 supported on each of the housings 11 so that it may be displaced toward and away from the corresponding end faces of the rolls 1*a* and 1*b*, and an end closure 3 loaded on each of the thruster bodies 21 so that it may closely contact upper portions of the end faces of the rolls 1*a* and 1*b*. When the end closure 3 is worn to a predetermined extent, then the rolling members 12 contact the end faces of the rolls 1*a* and 1*b* to thereby suppress wear of the end closure 3.

6 Claims, 8 Drawing Sheets

TWIN ROLL CONTINUOUS CASTER

TECHNICAL FIELD

This invention relates to the casting of metal strip by the technique of twin roll casting. It has particular but not exclusive application to the casting of ferrous metal strip.

In a twin roll caster molten metal is introduced between a pair of contra-rotated chilled casting rolls so as to form a casting pool of molten metal above the nip between the rolls. Metal shells solidify on the moving roll surfaces and are brought together at the nip between them to produce a solidified strip product at the outlet from the roll nip. The term "nip" is used herein to refer to the general region at which the rolls are closest together. The molten metal may be poured from a ladle into metal delivery apparatus which may take the form of one or more smaller vessels such as a tundish and/or distributor and a metal delivery nozzle, the metal flowing through such smaller vessel or vessels to direct it into the nip between the rolls, so forming a casting pool of molten metal supported on the casting surfaces of the rolls immediately above the nip and extending along the length of the nip.

It is necessary in a twin roll caster to confine the molten metal in the casting pool at the two ends of the nip between the casting rolls. Conventionally this is done by means of a pair of stationary refractory end closures which are held against the rotating rolls with sliding engagement at two ends of the nip so as to confine or dam the molten metal against escape from the casting pool. The ends of the nip generally coincide with respective coplanar ends of adjacent rolls, however where the ends of adjacent rolls are axially offset the nip terminates at the end innermost of the two adjacent ends of the adjacent rolls. In operating, the refractory end closures suffer from wear because of their sliding engagement with the rotating casting rolls and they must be replaced frequently, often after a single cast. This is particularly so when gouging occurs along the refractory end closures where they meet the roll edges. Such gouging can be caused by at least two phenomena. Firstly, the changing positions of the roll edges due to thermal expansion can lead to significant gouging. Parts of the roll passing through the pool during each rotation are heated progressively as they move from the upper regions of the pool to the nip. Consequently there is a tendency for the mid-parts of the roll in the region of the nip to expand outwardly more than the upper parts of the roll which deforms the roll end surface during casting. This can lead to excessive wear of the end closures adjacent the nip. Secondly, movements of the rolls relative to one another can lead to discrete particles of frozen metal becoming trapped at the roll edges and acting as abrasive particles against the end closures.

In an endeavour to overcome the end closure wear problem, it has been proposed to employ refractory end closures which are held in close proximity to but not in sliding engagement with the roll surfaces; for example, Australian Patent AU-B-56051/90 describes an end closure unit in which refractory end closures are set back slightly from the ends of the casting rolls so as to avoid sliding engagement. The end closure unit described comprises a refractory end closure member and roller members wherein, in use, the roller members are interposed between the refractory end closure member and the respective roll surface, the roller members being held in contact with the respective roll surfaces to maintain constant an initially set clearance between the refractory member and the respective roll surface.

There are a number of drawbacks with the above proposal. First, it is generally desirable to preheat refractory side closures to 1000° C or above prior to casting to avoid premature solidification at the triple point regions of the pool on start up. Preheating of this kind can be detrimental to the effective operation of the roller members. Additionally, during start up of casting, roll edges can expand non-uniformly and excessive gaps can develop between the proposed end closure unit and the rolls. Once metal penetrates the gap, thereby forming fins joined to the strip, the position is non-recoverable as the refractory member quickly wears through gouging by the metal fins.

Hence it is very important to maintain good sealing engagement between the end closures and the end surfaces of the rolls since leakage can lead to the formation of severe defects at the edges of the cast strip product and the solidifying leaked metal can cause rapid destruction of the wear surfaces of the side plates and complete loss of sealing.

FIGS. 8 and 9 illustrates an end closure applicator means or thruster in a continuous thin-strip caster (twin roll continuous caster) disclosed in JP-A-4-228243, which is adapted to maintain end closures in continuous sliding engagement with roll end surfaces.

Reference numerals 1*a* and 1*b* represent a pair of cooling rolls which are arranged substantially horizontally and in parallel with each other.

An end closure 3 is mounted on upper portions of each of opposite ends (one ends shown in FIGS. 8 and 9 and the other ends not shown in FIGS. 8 and 9) of the cooling rolls 1*a* and 1*b* to provide a molten metal pool 2 between the rolls 1*a* and 1*b*. The end closure 3 is pressed by a plurality of fluid jacks 4 against the ends of the rolls 1*a* and 1*b*.

Each of the fluid jacks 4 is connected at its one end to the end closure 3 and is connected at its other end to a fixed structure 5 so that the jack 4 is substantially in parallel with rotation axes of the rolls 1*a* and 1*b*. With the end closures 3 pressed against the upper portions of the opposite ends of the rolls 1*a* and 1*b* to prevent any leakage of the molten metal from the pool 2 between the rolls 1*a* and 1*b*, the rolls 1*a* and 1*b* on the left and right in FIG. 9 are concurrently rotated clockwise and counterclockwise, respectively, so that the metal solidifies between the rolls 1*a* and 1*b* into a strip 6 with a thickness substantially corresponding to a roll gap between the rolls 1*a* and 1*b*. The strip 6 is continuously delivered downward through the rolls 1*a* and 1*b*.

Arranged between the end closure 3 and the structure 5 is a displacement sensor unit 7 to sense the position of the end closure 3 with respect to the rolls 1*a* and 1*b*.

In the conventional twin roll continuous caster shown in FIGS. 8 and 9, during continuous casting of the strip 6, the end closures 3 are continuously pressed against the upper portions of the end faces of the rotating rolls 1*a* and 1*b*, resulting in severe wear of the end closures 3. The end closures 3 must be therefore replaced very frequently.

By the present invention, the end closures can be mounted and applied to the nip ends in such a way as to alleviate these problems. The present invention provides a twin roll continuous caster which can suppress wear of the end closures caused by the rotation of the cooling rolls.

DISCLOSURE OF THE INVENTION

A twin roll continuous caster according to a first aspect of the invention comprises a pair of cooling rolls arranged substantially horizontally and in parallel with each other, a first housing arranged to face on end faces of one ends of the rolls so that it may be displaced toward and away therefrom, a second housing arranged to face on end faces of the other ends of the rolls so that it may be displaced toward and away therefrom, rolling members rotatably supported by each of said housings so that they may contact the corresponding end faces of the rolls, a thruster supported on each of the housings so that it may be displaced toward and away from the corresponding end faces of the rolls, and an end closure loaded on each of the thrusters so that it may slidingly engage upper portions of the end faces of the rolls, the end closures initially protruding inwardly beyond the respective rolling members to provide an initial predetermined clearance between the rolling members and the respective corresponding end faces of the rolls.

Moreover, a twin roll continuous caster according to a second aspect of the invention comprises a pair of cooling rolls arranged substantially horizontally and in parallel with each other, said rolls being axially displaceable relative to each other, a first housing arranged to face on end faces of one ends of the rolls so that it may be displaced toward and away therefrom, a second housing arranged to face on end faces of the other ends of the rolls so that it may be displaced toward and away therefrom, rolling members rotatably supported by the first housing so that they may contact the end face of the one end of one of the rolls, rolling members rotatably supported by the second housing so that they may contact the end face of the other end of the other roll, a thruster supported on each of the housings so that it may be displaced toward and away from the corresponding end face of the corresponding roll, a first end closure loaded on the thruster at the one ends of the rolls so that it may slidingly engage an upper portion of the end face of the one end of the one roll, said first end closure closely contacting an outer periphery of the other roll from above, and a second end closure loaded on the thruster at the other ends of the rolls so that it may closely contact an upper portion of the end face of the other end of the other roll, said second end closure slidingly engaging an outer periphery of the one roll from above, the end closures initially protruding inwardly beyond the respective rolling members to provide an initial predetermined clearance between the rolling members and the respective corresponding end faces of the rolls.

In the twin roll continuous caster according to the first aspect of the invention, when each of the end closures loaded on the thrusters is worn to a predetermined extent due to pressing of the end closure against the upper portions of the end faces of one or the other ends of the rolls, the rolling members rotatably supported by the first or second housing contact the end faces of the rolls, thereby suppressing wear of the respective end closures.

In the twin roll continuous caster according to the second aspect of the invention, when the first end closure loaded on the thruster is worn to a predetermined extent due to pressing of the first end closure against the upper portion of the end face of the one end of the one roll, the rolling members rotatably supported by the first housing contact the end face of the one roll, thereby suppressing wear of the first end closure. When the second end closure loaded on the thruster is worn to a predetermined extent due to pressing of the second end closure against the upper portion of the end face of the other end of the other roll, the rolling members rotatably supported by the second housing contact the end face of the other roll, thereby suppressing wear of the second end closure.

According to the invention there is further provided apparatus for casting metal strip comprising a pair of casting rolls forming a nip between them, molten metal delivery means to deliver molten metal into the nip between the casting rolls to form a casting pool of molten metal above the nip between the rolls, pool confinement means to confine the casting pool of molten metal at each end of the nip, and roll drive means to rotate the rolls in mutually opposite directions so as to produce a solidified strip at the exit from the nip, wherein the pool confinement means comprises a pair of end closures disposed one at each end of the nip to contact the molten metal of the pool substantially completely across both ends of the pool and dam it against outflow from the pool, each end closure being adapted to slidingly engage both a surface of one roll and a surface of the other roll, a first housing arranged to face one end of the nip so as to be displaceable towards and away therefrom, a second housing arranged to face the other end of the nip so as to be displaceable towards and away therefrom, a rolling member rotatably supported by each of said housings, the rolling members being associated one with each of the pair of end closures and being adapted to engage one of the roll surfaces upon wear of the associated end closure, an end closure applicator means supported by each of the housings for displacement towards and away from respective ends of the nip wherein each of the pair of end closures is loaded on its respective applicator means for sliding engagement with an end surface of one of the rolls or an end surface of each of the rolls, wherein at least prior to start up of casting, the end closures protrude towards their respective end surfaces beyond the respective rolling member to provide an initial predetermined clearance between the said end surfaces of the rolls and the respective rolling member.

Preferably each housing is provided with a plurality of rolling members.

More preferably at least one of said plurality of rolling members of each housing is adapted to engage said end surface of one of the rolls and another of said rolling members is adapted to engage said end of the other of said rolls upon wear through said predetermined clearance.

Preferably each end closure slidingly engages both the end surface of said one of the rolls and the end surface of said other of the rolls.

In this preferred embodiment, when each of the end closures is worn to a predetermined extent due to pressing of the end closure against upper portions of the end surfaces of one or the other ends of the rolls, the rolling members rotatably supported by the first or second housing contact the end surfaces faces of the rolls, thereby suppressing wear of the respective end closures.

In embodiments in which the ends of the rolls are axially offset, at least one of said plurality of rolling members of each housing is adapted to engage end innermost of the two adjacent ends.

In twin roll continuous casters according to these embodiments of the invention, when a first end closure loaded on the applicator means is worn to a predetermined extent due to pressing against the upper portion of the end face of the one end of the one roll, the rolling members rotatably supported by the first housing contact the end face of the one roll, thereby suppressing wear of the first end closure and wherein when a second end closure loaded on the applicator means is worn to a predetermined extent due to pressing of the second end closure against the upper portion of the end face of the other end of the other roll, the rolling members rotatably supported by the second housing contact the end face of the other roll, thereby suppressing wear of the second end closure.

Additionally the present invention further provides a method of casting metal strip comprising:

supporting a casting pool of molten metal on a pair of chilled casting rolls forming a nip between them;

confining the casting pool by applying a pair of end closures to surfaces of the rolls at the ends of the nip; and rotating the chilled rolls in mutually opposite directions to produce a solidified strip product passing downwardly from the nip;

applying the end closures to end surfaces of the rolls by a pair of generally horizontally acting thrusters connected one to each of the end closures the thrusters applying opposing inward forces to the end closures;

applying rolling members towards end surfaces of the rolls, in unison with the application of said end closures, by said thrusters, the rolling members being rotatably connected one to each of said thrusters, and associated with each respective end closure;

setting the end closures to protrude inwardly beyond the associated rolling members, to slidably engage an end surface of one roll or the end surfaces of both rolls to provide an initial predetermined clearance between the associated rolling members and the respective said end surface or surfaces;

enabling the end closures to slidably engage the end surfaces of the rolls and wear;

and permitting the end closures to wear sufficiently to permit the rolling members to contact the said respective end surfaces.

Preferably each end closure is applied to the end surface of each of its respective rolls.

Preferably setting of the end closures is effected by means of additional thrusters prior to the commencement of casting, said additional thrusters being adapted to drive the end closures inwardly towards or outwardly away from their respective roll end surfaces.

Preferably further, after the commencement of casting and casting conditions being obtained, the end closures are driven outwardly away from their respective roll surfaces by means of said additional thrusters, thereby permitting the rolling members to contact the said respective roll end surfaces earlier than had the end closures been allowed to wear through the initially predetermined clearance.

Additionally during casting conditions, the end closures may be driven inwardly towards their respective roll end surfaces by means of said additional thrusters such that the end closures protrude further inwardly beyond the associated rolling member for a period of time until the end closures wear sufficiently to permit the rolling members to again contact the said respective roll end surfaces.

Preferably the pair of end closures are preheated to at least 1000° C at a remote location prior to the commencement of casting.

BRIEF DESCRIPTION OF DRAWINGS

In order that the invention may be more fully explained, two particular forms of apparatus and its operation will now be described in some detail with reference to the accompanying drawings in which.

DESCRIPTION OF PREFERRED EMBODIMENTS

Figure 8:
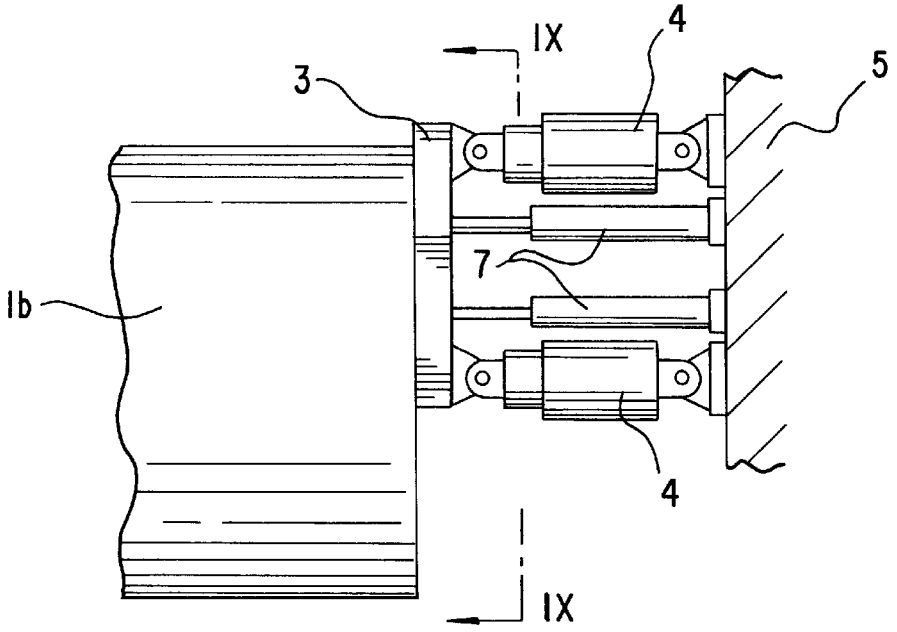
FIG.8 PRIOR ART
FIG. 8 is a partially cutaway front view of a conventional twin roll continuous caster.
Figure 9:
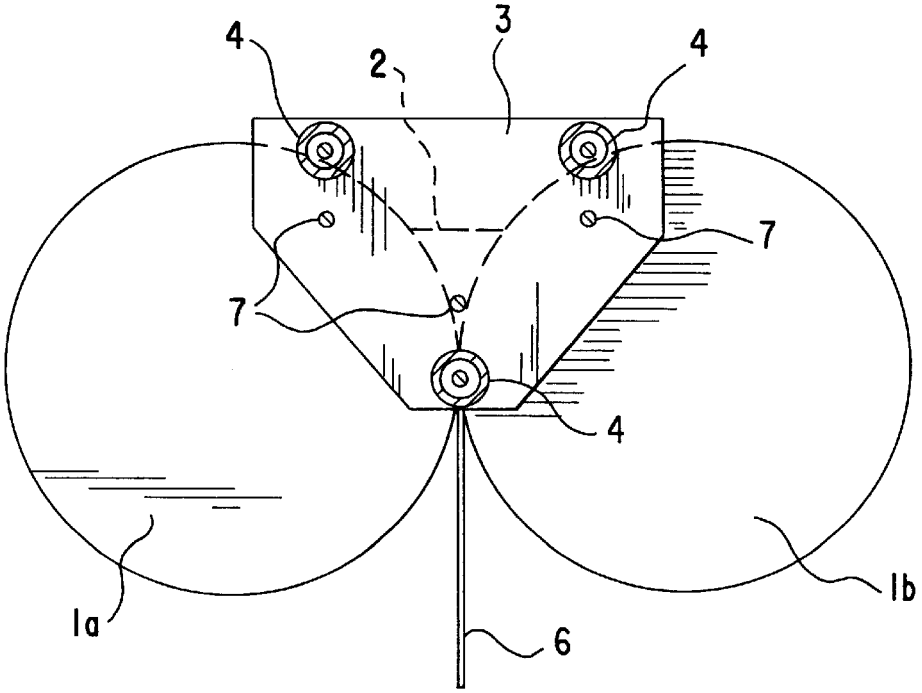
FIG.9 PRIOR ART
FIG. 9 is a view looking in the direction of arrows IX in FIG. 8.

FIGS. 1 to 4 represent a first embodiment of a twin roll continuous caster according to the invention. In these figures, the same components as in FIGS. 8 and 9 are referred to by the same reference numerals.

FIGS. 1 to 4 illustrate only components on one ends of a pair of cooling rolls 1*a* and 1*b* which constitute the twin roll continuous caster. Components on the other ends of the rolls 1*a* and 1*b* not shown in FIGS. 1 to 4 are arranged in linear symmetry to the components arranged on the one ends.

Reference numeral 8 represents a support stand which has at its upper surface a guide rail 9 extending in parallel with the rolls 1*a* and 1*b*.

The stand 8 is arranged on each of the one ends (the ends shown in FIGS. 1 to 4) and the other ends (the ends not shown in FIGS. 1 to 4) of the rolls 1*a* and 1*b* to face on lower portions of the rolls 1*a* and 1*b*.

Reference numeral 10 represents a moving frame which is arranged on the stand 8 so that it may be displaced along the rail 9 toward and away from the rolls 1*a* and 1*b*.

Reference numeral 11 denotes a housing which is loaded on an upper portion of the frame 10. According to the first aspect, the housing at the one ends of the rolls 1*a* and 1*b* corresponds to said "first housing" and that at the other ends of the rolls 1*a* and 1*b*, to said "second housing".

The housing 11 is formed with a bore 11*a* which runs through the housing 11 in parallel with the rolls 1*a* and 1*b*.

Reference numeral 12 represents rolling members in the form of cam rollers which are rotatably supported on the housing 11 via a roller holder 29 so that they may contact the end faces of the rolls 1*a* and 1*b*.

Reference numeral 13 denotes a bracket attached to an end of the stand 8 away from the rolls 1*a* and 1*b*.

Reference numeral 14 represents a cylinder comprising a cylinder main body 14*a* and a piston rod 14*b* protruded from the main body 14*a* toward the end faces of the rolls 1*a* and 1*b*.

The cylinder main body 14*a* is supported by the bracket 13 such that the piston rod 14*b* faces on an end of the frame 10 away from the rolls 1*a* and 1*b*. The piston rod 14*b* passes through the bracket 13 and is connected to the end of the frame 10 away from the rolls 1*a* and 1*b*. When fluid pressure is applied to a headside fluid chamber of the main body 14*a* away from the rolls 1*a* and 1*b*, the housing 11 and the cam rollers 12 are displaced, together with the frame 10, toward the rolls 1*a* and 1*b*. When fluid pressure is applied to a rodside fluid chamber of the main body 14*a* nearer to the rolls 1*a* and 1*b*, the housing 11 and the cam rollers 12 are displaced, together with the frame 10, away from the rolls 1*a* and 1*b*.

Reference numeral 15 represents a bracket which stands up from a fixed structure 16 such as foundation at a side away from the rolls 1*a* and 1*b* with respect to the stand 8.

Reference numeral 17 denotes a motor comprising a motor main body 17*a* and a drive shaft 17*b* extending from the main body 17*a* toward the end faces of the rolls 1*a* and 1*b*.

The above-mentioned motor main body 17*a* is supported by the bracket 15 such that the drive shaft 17*b* is coaxially with the boring 11*a* of the housing 11.

Reference numeral 18 represents a hollow intermediate shaft having a spline nut 19 embedded in its tip end.

The intermediate shaft 18 is rotatably supported at its tip end by the bracket 13 and has a base end connected to the drive shaft 17*b* of the motor 17.

Reference numeral 20 denotes a spline shaft formed with a thread 20*a* at its tip end.

The spline shaft 20 is rotatably supported at its portion adjacent to its tip end by an end of the housing 11 away from the rolls 1*a* and 1*b* so that the shaft 20 can be rotated peripherally but cannot be displaced axially. The shaft 20 is engaged at its base end with the nut 19 in the tip end of the shaft 18.

Therefore, the shaft 20 is displaceable together with the housing 11 and frame 10 in parallel with the rolls 1*a* and 1*b*, and the rotation of the shaft 18 is transmitted to the shaft 20 via the nut 19.

Reference numeral 21 represents a thruster body with a nut 22 embedded in its base end.

The thruster body 21 is inserted in the boring 11*a* such that it can be displaced toward and away from the rolls 1*a* and 1*b* and cannot be rotated peripherally.

The nut 22 is engaged with the thread 20*a* on the tip end of the shaft 20. When the motor 17 is rotated in normal or reverse direction, the rotating force of the motor 17 is transmitted to the shaft 20 via the shaft 18 and nut 19. By the rotation of the shaft 20 with respect to the nut 22, the thruster body 21 is displaced together with the nut 22 in a direction toward or away from the rolls 1*a* and 1*b*.

Reference numeral 23 represents a end closure support member, which is attached to a tip end of the thruster body 21 so as to face on the upper portions of the end faces of the rolls 1*a* and 1*b*.

Arms 24 are pivotally supported through brackets 25 by the upper portion of the support member 23 and are engaged with opposite sides of the upper portion of the end closure 3 which is in contact with the support member 23 so as to face on the upper portions of the ends of the rolls 1*a* and 1*b*. The support member 23 is formed, at its lower portion, with a stopper 26 which is engaged from below with the lower portion of the end closure 3 in contact with the support member 23. As the thruster body 21 is displaced, the end closure 3 is displaced in a direction toward or away from the rolls 1*a* and 1*b*.

Each of the arms 24 has an elastic member such as spring and is urged to engage with the end closure 3 in contact with the support member 23 by urging members 27 mounted on the brackets 25.

Figure 1:
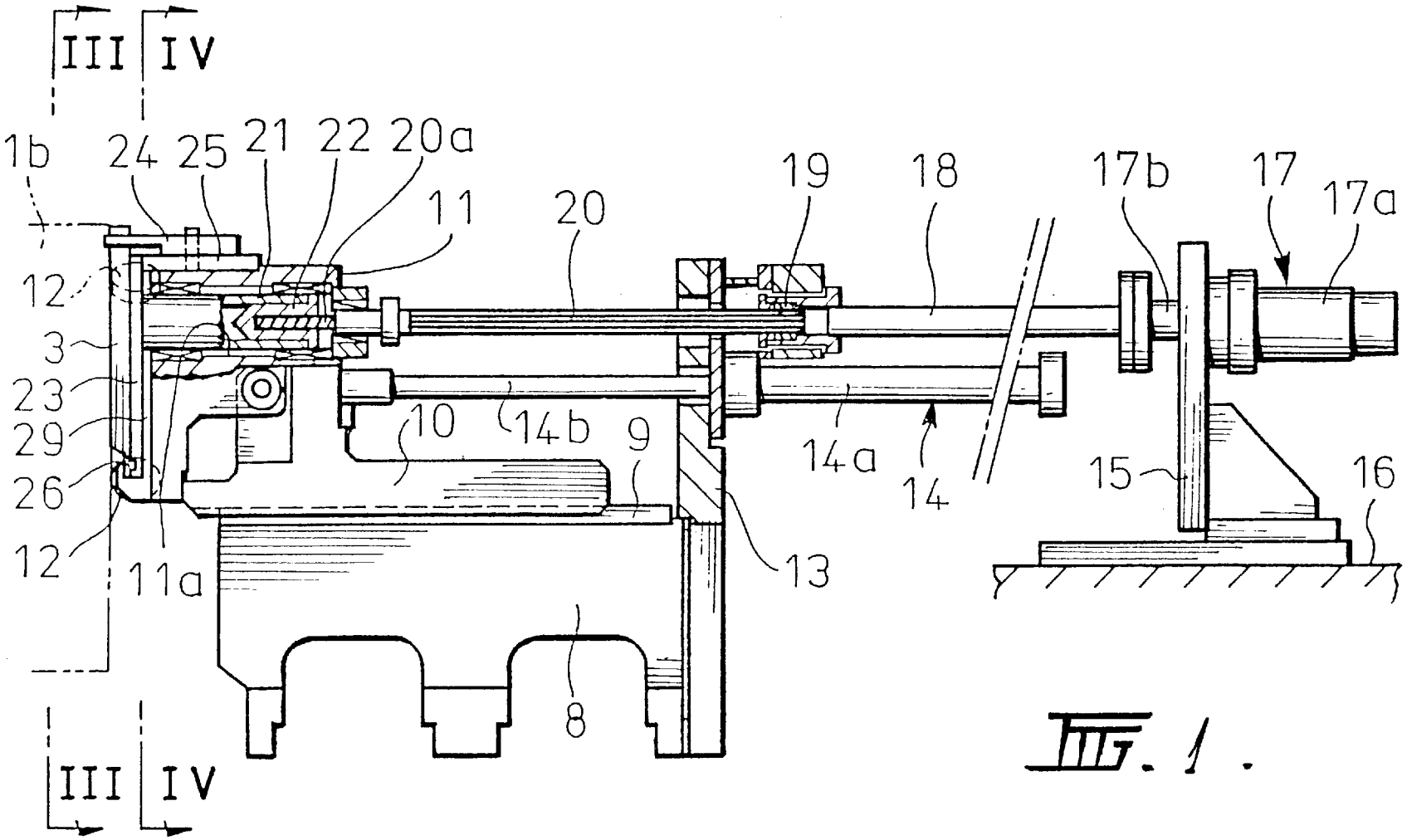
FIG. 1 is a partially cutaway front view of a first embodiment of a twin roll Continuous caster according to the invention.
Figure 2:
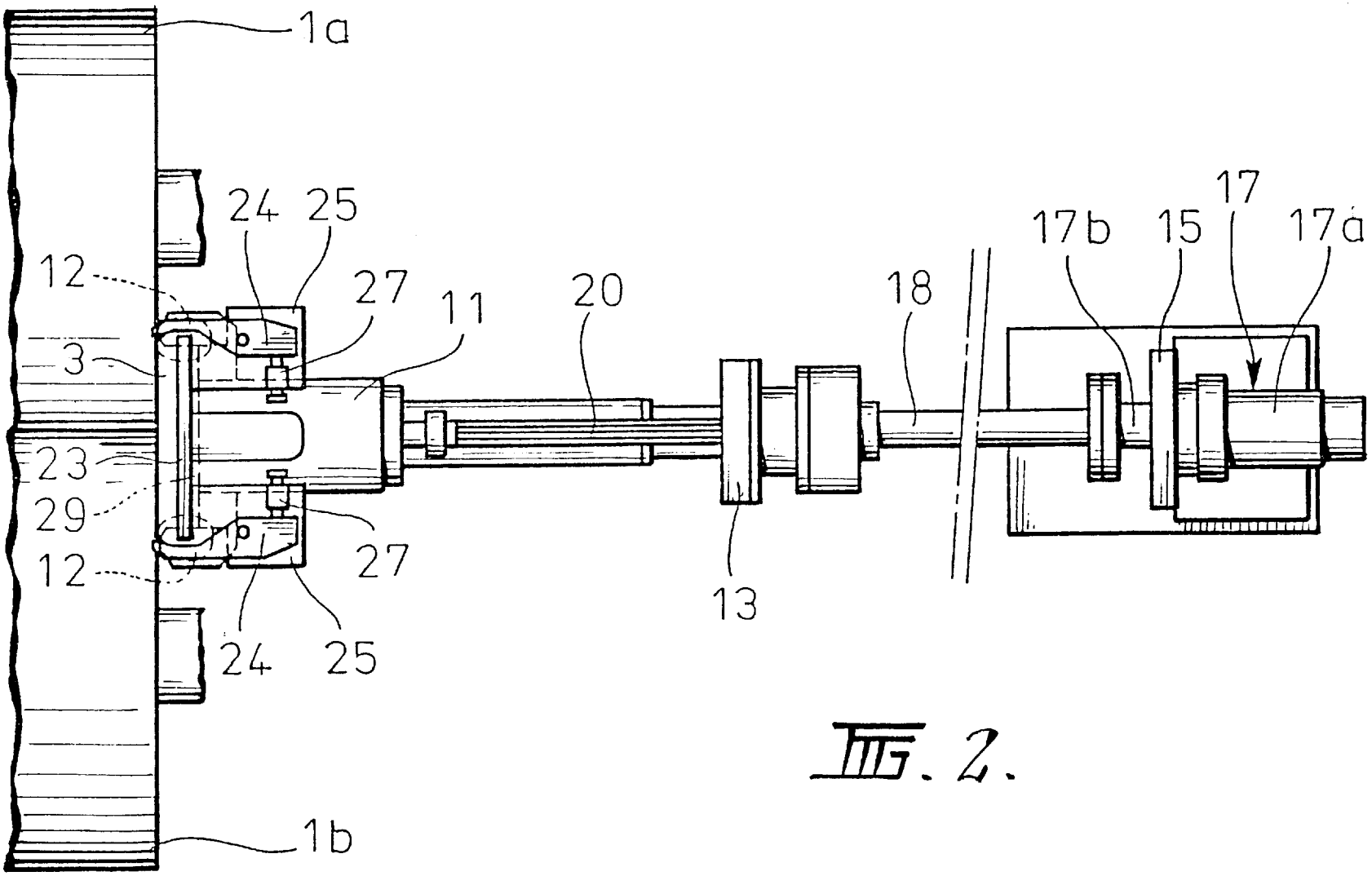
FIG. 2 is a plan view of the first embodiment of the twin roll continuous caster according to the invention.
Figure 3:
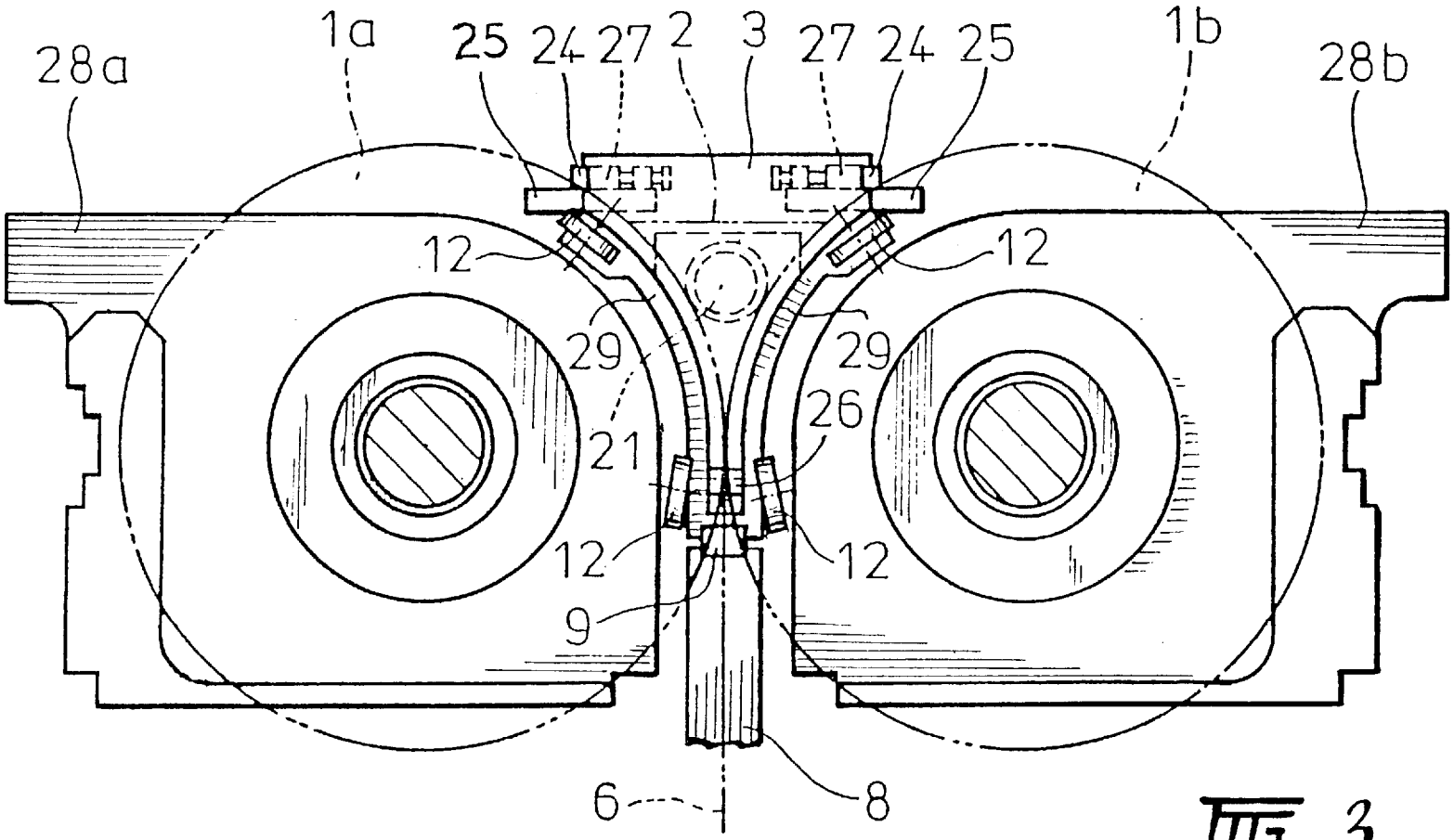
FIG. 3 is a view looking in the direction of arrows III in FIG. 1.
Figure 4:
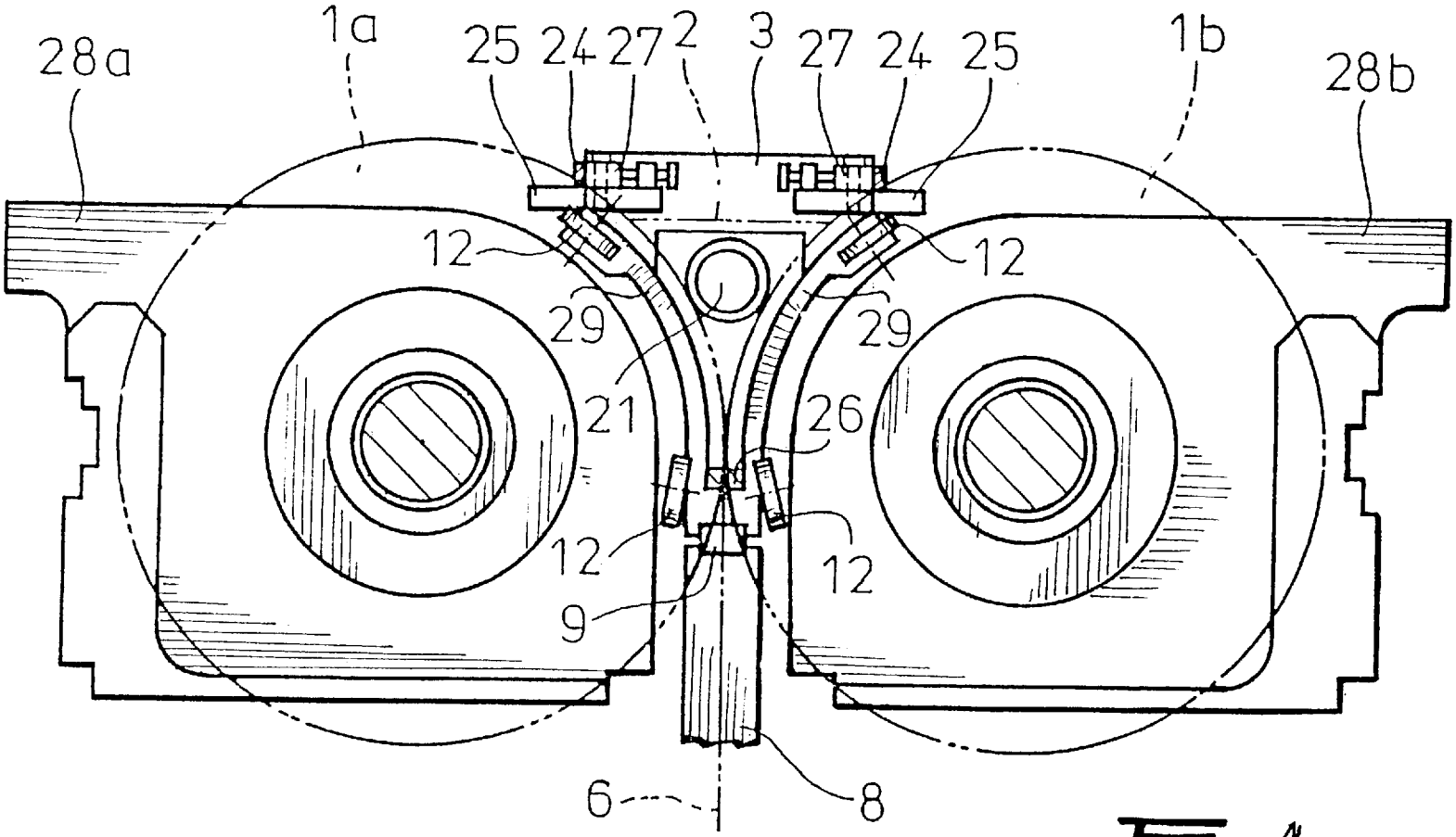
FIG. 4 is a view looking in the direction of arrows IV in FIG. 1.

In FIGS. 3 and 4, reference numerals 28*a* and 28*b* represent bearing boxes which rotatably support journals of the rolls 1*a* and 1*b*, respectively.

Mode of operation of the twin roll continuous caster shown in FIGS. 1 to 4 will be described.

When the strip 6 is to be continuously cast by the cooling rolls 1*a* and 1*b*, the end closure 3 is supported on the support member 23, using the arms 24 and stopper 26, so as to face on the upper portions of the end faces of the rolls 1*a* and 1*b*. By activating the motor 17, if necessary, to displace the thruster body 21 in a direction parallel to the rolls 1*a* and 1*b* with respect to the housing 11, relative position of the thruster body 21 to the housing 11 is adjusted such that the surface of the end closure facing on the rolls 1*a* and 1*b* is protruded toward the end faces of the rolls 1*a* and 1*b* little more than the cam rollers 12 rotatably supported on the housing 11 via the holder 29.

After the relative position of the thruster body 21 to the housing 11 is adjusted, fluid pressure is applied to the head-side fluid chamber of the cylinder main body 14*a* of the cylinder 14 to displaced the housing 11 together with the frame 10 toward the rolls 1*a* and 1*b*. Thus, the end closure 3 is brought into contact with the upper portions of the end faces of the rolls 1*a* and 1*b* and the cam rollers 12 are brought into positions very close to the end faces of the rolls 1*a* and 1*b*.

With the end closure 3 pressed against the upper portions of the end faces of the rolls 1*a* and 1*b* by the cylinder 14, the molten metal pool 2 is formed between the rolls 1*a* and 1*b* and the rolls 1*a* and 1*b* at the left and right in FIGS. 3 and 4 are concurrently rotated clockwise and counterclockwise, respectively. Thus, metal solidifies between the rolls 1*a* and 1*b* into the strip 6 with a thickness corresponding to a roll gap between the rolls 1*a* and 1*b* and is continuously delivered downward through the rolls 1*a* and 1*b*.

On the other hand, each of the end closures 3 is worn due to pressing of the same against the upper portions of the end faces of the rolls 1*a* and 1*b* as the strips 6 are repeatedly cast. The cam rollers 12 rotatably supported on the housing 11 via the holder 29 are displaced closer to the end faces of the rolls 1*a* and 1*b* in accordance with the amount of wear of the end closure 3.

Eventually the end closure 3 is worn to an extent to conform with the end faces of the rolls 1*a* and 1*b*. Then, the cam rollers 12 rotatably supported on the housing 11 via the holder 29 contact the end faces of the rolls 1*a* and 1*b* and roll over the end faces of the rolls 1*a* and 1*b*, thereby suppressing wear of the end closure 3.

Where the end closure 3 is to be replaced in the twin roll continuous caster shown in FIGS. 1 to 4, fluid pressure is applied to the rod-side fluid chamber of the cylinder main body 14*a* of the cylinder 14 to displace the housing 11 together with the frame 10 in a direction away from the rolls 1*a* and 1*b*. Then, the arms 24 are disengaged from the end closure 3 and the latter is removed from the support member 23. A new end closure 3 is mounted on the support member 23.

Figure 5:
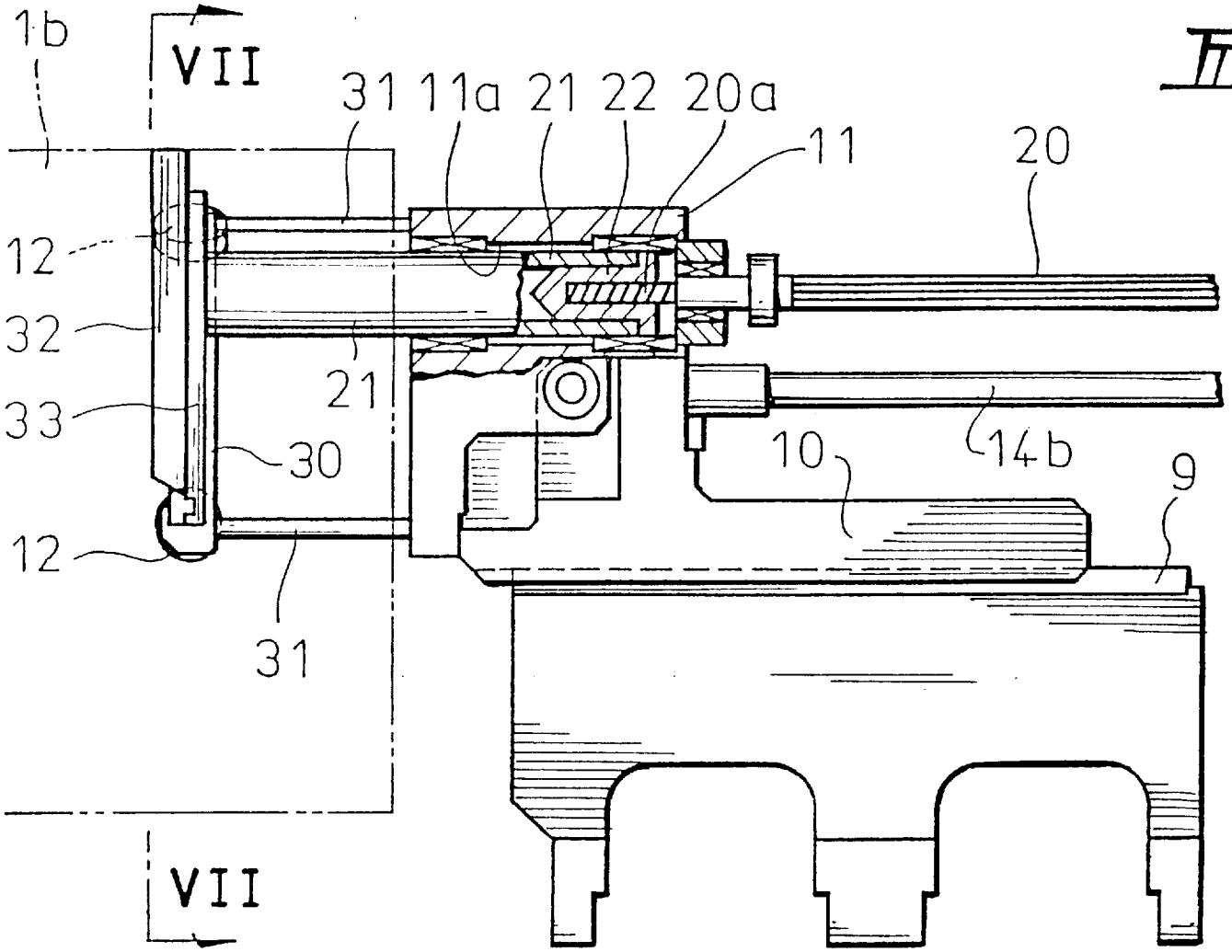
FIG. 5 is a partially cutaway front view of a second embodiment of a twin roll Continuous caster according to the invention.
Figure 6:
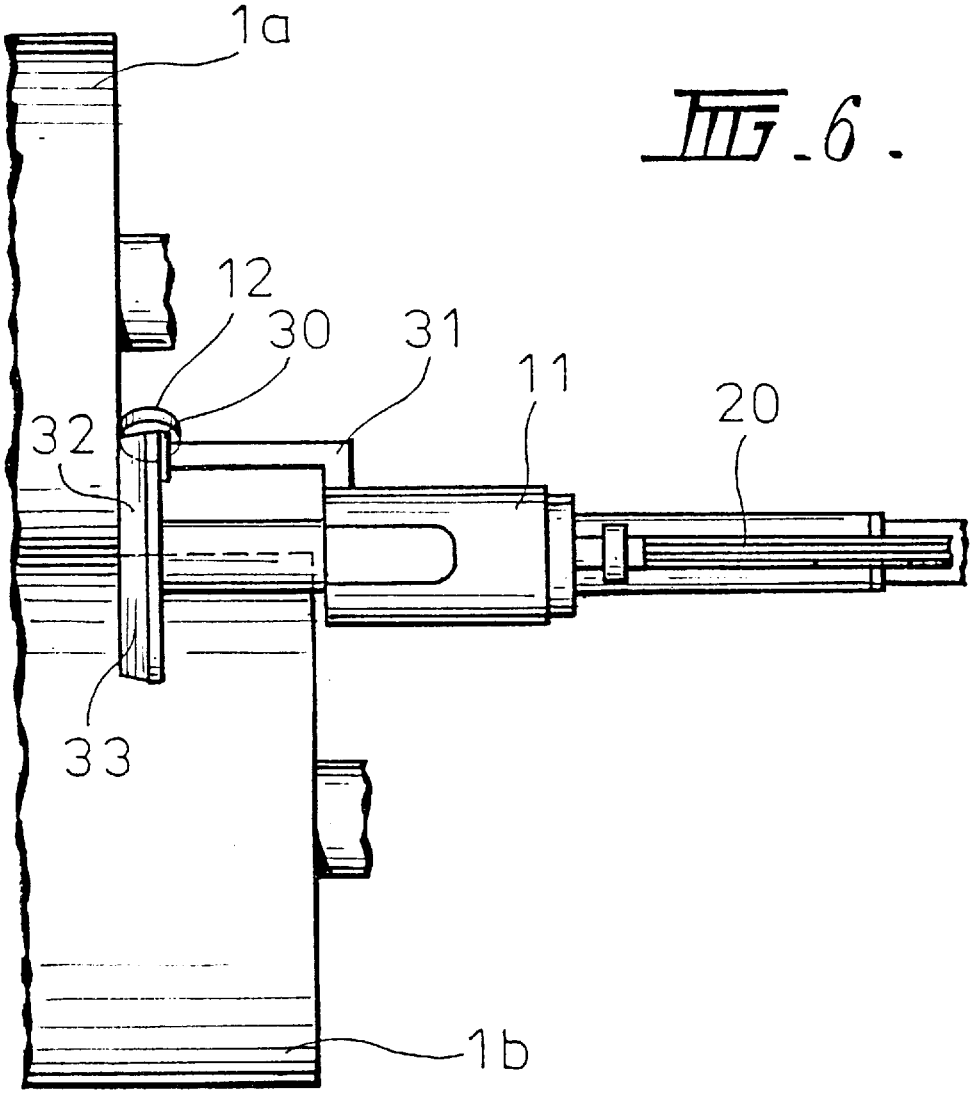
FIG. 6 is a plan view of the second embodiment of the twin roll continuous caster according to the invention.
Figure 7:
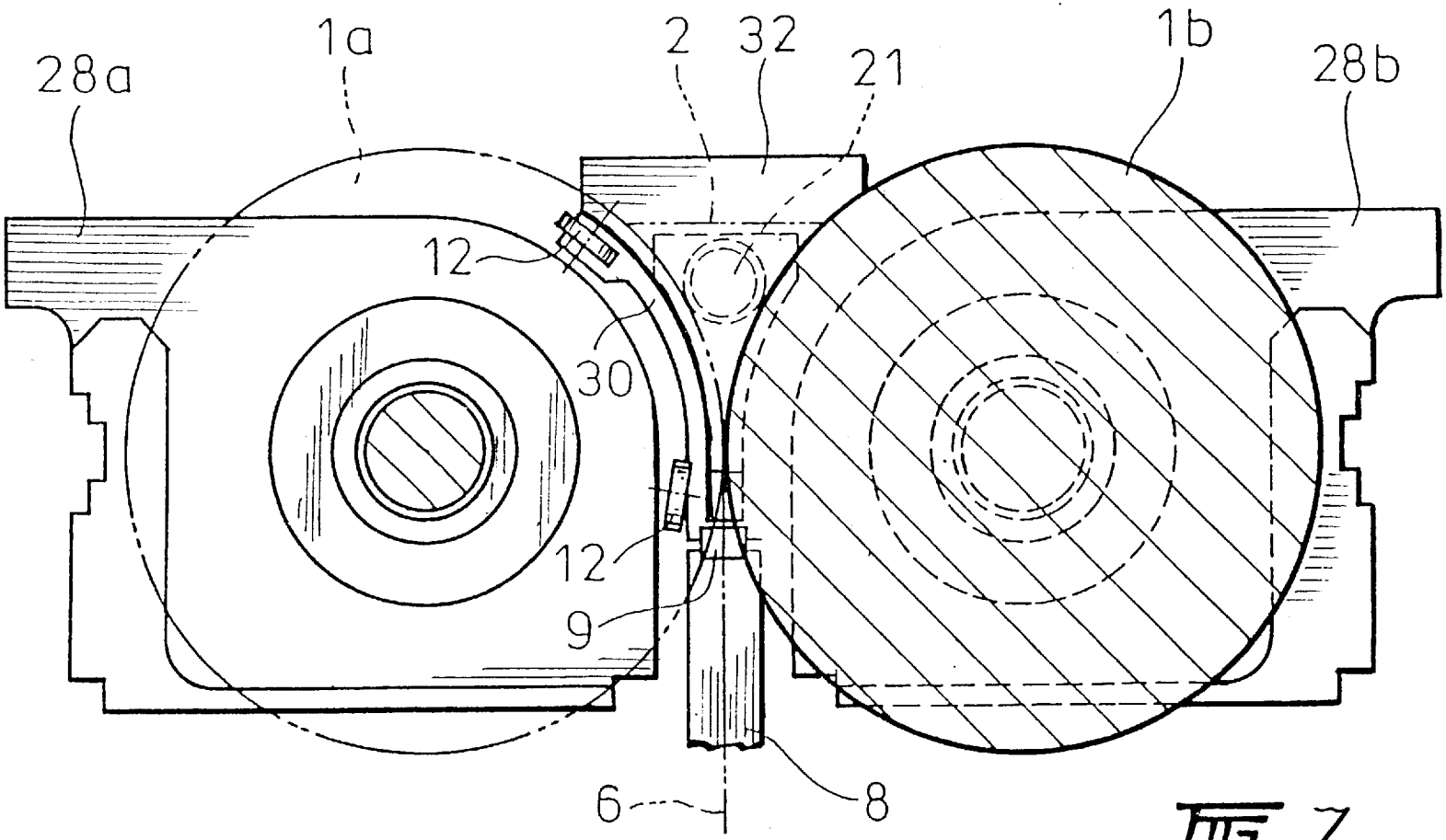
FIG. 7 is a view looking in the direction of arrows VII in FIG. 5.

FIGS. 5 to 7 represent a second embodiment of the twin roll continuous caster according to the invention. In these figures, the same components as in FIGS. 1 to 4 are referred to by the same reference numerals.

Shown in FIGS. 5 to 7 are only the components on one ends of paired cooling rolls 1*a* and 1*b* which constitute a twin roll continuous caster. Components arranged on the other ends of the rolls 1*a* and 1*b* not shown in FIGS. 5 to 7 are arranged in point symmetry to the components arranged on the one ends. As drive means for the frame 10 and shaft 20, a cylinder 14 and motor are used in the same manner as in the first embodiment of the invention (See FIGS. 1 and 2).

In the twin roll continuous caster shown in FIGS. 5 to 7, the paired rolls 1*a* and 1*b* are designed to be axially displaced relative to each other together with the bearing box 28*a* or 28*b* by a roll shift mechanism (not shown), so that the rolls 1*a* and 1*b* can be positioned such that the end face of the roll 1*b* is protruded more outwardly than the end face of the roll 1*a* at one ends of the rolls 1*a* and 1*b* (See FIG. 6) and the end face of the roll 1*a* is protruded more outwardly than the end face of the roll 1*b* at the other ends of the rolls 1*a* and 1*b*.

According to the second aspect the housing 11 at the one ends (the ends shown in FIGS. 5 to 7) of the rolls 1*a* and 1*b* corresponds to said "first housing" and that at the other ends of the rolls 1*a* and 1*b*, to said "second housing".

On the housing 11 at the one ends of the rolls 1*a* and 1*b*, cam rollers 12 are rotatably supported via a roller holder 30 and a bracket 31 so that they may contact only the end face of the one roll 1*a* (FIG. 6). On the housing 11 at the other ends of the rolls 1*a* and 1*b*, the cam rollers 12 are rotatably supported via the roller holder 30 and the bracket 31 so that they may contact only the end face of the other roll 1*b*.

Further, a thruster body 21 inserted in the housing 11 is designed to be longer in length than the one shown in FIGS. 1 to 4. With the end face of the roll 1*b* protruded more outwardly than the end face of the roll 1*a* at the one ends of the rolls 1*a* and 1*b* and with the end face of the cooling roll 1*a* protruded more outwardly than the end face of the roll 1*b* at the other ends of the cooling rolls 1*a* and 1*b*, the tip end of the thruster body 21 at the one ends of the rolls 1*a* and 1*b* is positioned above the one end of the other roll 1*b* (FIG. 6), and the tip end of the thruster body 21 at the other ends of the rolls 1*a* and 1*b* is positioned above the other end of the one roll 1*a*.

An end closure support member 33 is attached to the tip end of the thruster body 21 as described above so as to load an end closure 32 on it.

According to the second aspect, the end closure 32 at the one ends (the ends shown in FIGS. 5 to 7) of the rolls 1*a* and 1*b* corresponds to said "first end closure"and that at the other ends (the ends not shown in FIGS. 5 to 7), to said "second end closure".

The end closure 32 positioned at the one ends of the rolls 1*a* and 1*b* is loaded on the support member 33 arranged at the one ends of the rolls 1*a* and 1*b* such that it may closely contact the upper portion of the end face of the one end of the one roll 1*a* and closely contact an outer periphery of the other roll 1*b* from above.

The end closure 32 positioned at the other ends of the rolls 1*a* and 1*b* is loaded on the support member 33 arranged at the other ends of the rolls 1*a* and 1*b* such that it may closely contact the upper portion of the roll end face of the other end of the other roll 1*b* and closely contact an outer periphery of the one roll 1*a* from above.

Next, mode of operation of the twin roll continuous caster shown in FIGS. 5 to 7 will be described.

When the strip 6 is to be continuously cast through the cooling rolls 1*a* and 1*b*, the thruster body 21 is displaced in a direction parallel to the rolls 1*a* and 1*b* with respect to the housing 11 to thereby adjust the relative position of the thruster body 21 to the housing 11 such that the face of the end closure 32 facing on the rolls 1*a* and 1*b* is protruded toward the end faces of the rolls 1*a* and 1*b* a little more than the cam rollers 12 rotatably supported on the housing 11 via the holder 30 and bracket 31.

After the relative position of the thruster body 21 to the housing 11 is adjusted, the housing 11 is displaced together with the frame 10 in a direction toward the rolls 1*a* and 1*b*. Then, the end closure 32 positioned at the one ends of the rolls 1*a* and 1*b* closely contacts the upper portion of the end face of the one end of the one roll 1*a* and closely contacts an outer periphery of the roll 1*b*. The cam rollers 12 at the one ends of the rolls 1*a* and 1*b* are brought into positions very close to the end face of the one end of the one roll 1*a*. The end closure 32 positioned at the other ends of the rolls 1*a* and 1*b* closely contacts the upper portion of the end face of the other end of the other roll 1*b* and closely contacts an outer periphery of the one roll 1*a* from above. The cam rollers 12 at the other ends of the rolls 1*a* and 1*b* are brought into positions very close to the end face of the other end of the other roll 1*b*.

With the end closure 32 positioned at the one ends of the rolls 1*a* and 1*b* being pressed against the end face of the one roll 1*a* and the end closure 32 positioned at the other ends of the rolls 1*a* and 1*b* being pressed against the end face of the other roll 1*b*, the molten metal pool 2 is formed between the rolls 1*a* and 1*b* and the rolls 1*a* and 1*b* on the left and right in FIG. 7 are concurrently rotated clockwise and counterclockwise, respectively. Then, the metal solidifies between the rolls 1*a* and 1*b* into the strip 6 with a thickness corresponding to a roll gap between the rolls 1*a* and 1*b* and is delivered downward through the rolls 1*a* and 1*b*.

On the other hand, the end closure 32 is worn due to pressing of the same against the upper portion of the end face of the roll 1*a* or 1*b* as the strips 6 are repeatedly cast. The cam rollers 12 rotatably supported on the housing 11 via the holder 30 and bracket 31 are displaced closer to the end face of the roll 1*a* or 1*b* in accordance with the amount of wear of the end closure 32.

Eventually the end closure 32 is worn to an extent to conform with the end face of the roll 1*a* or 1*b*. Then, the cam rollers 12 contact the end face of the roll 1*a* or 1*b* and roll over the end face of the roll 1*a* or 1*b*, thereby suppressing wear of the end closure 32.

In the twin roll continuous caster shown in FIGS. 5 to 7, when the thickness of the strip 6 to be cast through the rolls 1*a* and 1*b* is to be changed, the rolls 1*a* and 1*b* are relatively and axially moved to increase or decrease the spacing between the end closures 32 which contacts the end face of the roll 1*a* at the one ends of the one rolls 1*a* and 1*b* and the end closure 32 which contacts the end face of the other roll 1*b* at the other ends of the rolls 1*a* and 1*b*.

As described above, a twin roll continuous caster according to the invention can exhibit various excellent effects as described below:

(1) In a twin roll continuous caster according to the first aspect of the invention, when each of the end closures loaded on the thrusters is worn to a predetermined extent due to pressing of the same against the upper portion of the end face of the one or the other end of the rolls, the cam rollers rotatably supported on the first or second housing contact the end face of the rolls, whereby wear of the end closures can be suppressed and maintenance work for the twin roll continuous caster can be relieved.

(2) In the twin roll continuous caster according to the second aspect of the invention, when the first end closure loaded on the thruster is worn to a predetermined extent due to pressing of the same against the upper portion of the end face of one end of one of the rolls, the cam rollers rotatably supported on the first housing contact the end face of the one end of the one roll, whereby the wear of the first end closure can be suppressed. When the second end closure loaded on the thruster is worn to the predetermined extent due to pressing of the same against the upper portion of the end face of the other end of the other roll, the cam rollers rotatably supported on the second housing contact the end face of the other end of the other roll, whereby the wear of the second end closure can be suppressed moreover, maintenance work for the twin roll continuous caster can be relieved.

The illustrated constructions have been advanced by way of example only and it could be modified considerably. For example, the rolling members are described above as cam rollers, however rolling members in the form of balls or other bearing members can also be used. Additionally the end closures may be biased against the surfaces of the rolls by thrusters in the form of springs or other biasing means.

It is accordingly to be understood that the invention is in no way limited to the details of the illustrated construction and that many modifications and variations will fall within its spirit and scope which extends to every novel feature and combination of features herein disclosed.

We claim:

1. A method of casting metal strip comprising:

supporting a casting pool of molten metal on a pair of chilled casting rolls forming a nip between them;

confining the casting pool by applying a pair of end closures to surfaces of the rolls at the ends of the nip; and rotating the chilled rolls in mutually opposite directions to produce a solidified strip product passing downwardly from the nip;

applying the end closures to end surfaces of the rolls by a pair of generally horizontally acting thrusters connected one to each of the end closures, the thrusters applying opposing inward forces to the end closures;

applying rolling members towards end surfaces of the rolls, in unison with the application of said end closures by said thrusters, the rolling members being rotatably connected one to each of said thrusters, and associated with each respective end closure;

setting the end closures to protrude inwardly beyond the associated rolling members, to slidably engage an end surface of one roll or the end surfaces of both rolls to provide an initial predetermined clearance between the associated rolling members and the respective said end surface or surfaces;

enabling the end closures to slidably engage the end surfaces of the rolls and wear;

and permitting the end closures to wear sufficiently to permit the rolling members to contact the said respective end surfaces.

2. A method according to claim 1 wherein said setting of the end closures is effected by means of additional thrusters prior to the commencement of casting, said additional thrusters being adapted to drive the end closures inwardly towards or outwardly away from their respective roll end surfaces.

3. A method according to claim 2 wherein after the commencement of conditions upon stable casting conditions being obtained, the end closures are driven outwardly away from their respective roll surfaces by means of said additional thrusters, thereby permitting the rolling members to contact the said respective roll end surfaces earlier than had the end closures been allowed to wear through the initially predetermined clearance.

4. A method according to claim 2 wherein during unstable casting conditions, the end closures are driven inwardly towards their respective roll end surfaces by means of said additional thrusters such that the end closures protrude further inwardly beyond the associated rolling member for a period of time until the end closures wear sufficiently to permit the rolling members to again contact the said respective roll end surfaces.

5. A method as defined in any one of claims 1 to 4 wherein the pair of end closures are preheated to at least 1000° C at a remote location prior to the commencement of casting.

6. A method according to claim 1 wherein each end closure is applied to the end surface of each of its respective rolls.

* * * * *